US008161758B2

(12) United States Patent
Bailey et al.

(10) Patent No.: US 8,161,758 B2
(45) Date of Patent: Apr. 24, 2012

(54) AUTOMATIC DEFROST EVAPORATOR SYSTEMS

(75) Inventors: Bruce C. Bailey, Lewisburg, TN (US); John W. Cook, Franklin, TN (US)

(73) Assignee: Dole Refrigerating Company, Lewisburg, TN (US)

( * ) Notice: Subject to any disclaimer, the term of this patent is extended or adjusted under 35 U.S.C. 154(b) by 695 days.

(21) Appl. No.: 12/372,494

(22) Filed: Feb. 17, 2009

(65) Prior Publication Data

US 2010/0205983 A1 Aug. 19, 2010

(51) Int. Cl.
*F25D 21/00* (2006.01)

(52) U.S. Cl. ..... 62/80; 62/151; 62/234

(58) Field of Classification Search ..... 62/80, 82, 62/151, 155, 156, 234, 282
See application file for complete search history.

(56) References Cited

U.S. PATENT DOCUMENTS

| | | | | |
|---|---|---|---|---|
| 2,607,203 | A | 8/1952 | Kleist | |
| 2,701,455 | A | 2/1955 | Kleist | |
| 2,875,595 | A | 3/1959 | Kleist | |
| 3,042,381 | A | 7/1962 | Lasak et al. | |
| 3,720,074 | A * | 3/1973 | Jansen | 62/272 |
| 3,727,422 | A | 4/1973 | Apple, Jr. | |
| 3,756,037 | A * | 9/1973 | Raufeisen et al. | 62/156 |
| 3,826,101 | A * | 7/1974 | Fischer | 62/82 |
| 3,845,638 | A * | 11/1974 | Apple et al. | 62/426 |
| 3,875,758 | A * | 4/1975 | Fischer | 62/157 |
| 3,905,203 | A * | 9/1975 | Jacob | 62/272 |
| 4,009,594 | A * | 3/1977 | Swanson | 62/278 |
| 4,043,144 | A | 8/1977 | Klotz et al. | |
| 4,110,997 | A * | 9/1978 | Klotz et al. | 62/81 |
| 4,383,415 | A * | 5/1983 | Jacob | 62/81 |
| 4,756,164 | A * | 7/1988 | James et al. | 62/119 |
| 5,201,192 | A * | 4/1993 | Hara | 62/285 |
| 5,761,920 | A * | 6/1998 | Wilson et al. | 62/138 |
| 6,427,463 | B1 * | 8/2002 | James | 62/186 |
| 6,595,019 | B1 | 7/2003 | Millette et al. | |
| 7,296,428 | B2 * | 11/2007 | Cleland | 62/196.1 |
| 2005/0092001 | A1 * | 5/2005 | Shah | 62/196.4 |
| 2005/0097907 | A1 * | 5/2005 | Cleland | 62/196.3 |

* cited by examiner

*Primary Examiner* — Mohammad Ali
(74) *Attorney, Agent, or Firm* — Cook Alex Ltd.

(57) ABSTRACT

A method of defrosting a eutectic plate of a refrigeration system involves activating a defrost system when a power source is connected to the refrigeration system. The defrost system is operated for all or a portion of a defrost cycle and is then deactivated. The initiation of a subsequent defrost cycle is prevented until the power source has been disconnected from the refrigeration system for at least a selected amount of time. A defrost system may include a controller programmed to carry out the method and automatically initiate a series of defrost cycles.

44 Claims, 2 Drawing Sheets

AUTOMATIC DEFROST EVAPORATOR SYSTEMS

BACKGROUND

The present subject matter relates generally to systems and methods for defrosting eutectic plates of a refrigeration system.

Refrigeration plates for maintaining a low temperature in a storage area are well known. For example, trucks with refrigerated storage areas are commonly used for transporting frozen or perishable foods. In a typical storage area, a refrigeration unit comprises a plurality of metal plates. Each metal plate has a cavity filled with an amount of freezable fluid or eutectic solution and a conduit immersed in the eutectic solution. The conduit winds back and forth through the interior of the plate, with the two ends of the conduit communicating with the outside of the plate. An exemplary refrigeration plate is described in U.S. Pat. No. 3,756,037, the disclosure of which is hereby incorporated herein by reference.

The ends of the conduit are connected in line with a refrigeration circuit including, among other things, a condenser, a compressor, and a volatile refrigerant that flows through the circuit. An exemplary refrigeration circuit is described in U.S. Pat. No. 4,043,144, the disclosure of which is hereby incorporated herein by reference. A "freezing cycle" is implemented to freeze the eutectic solution during a period of non-use of the refrigerated storage area. Once the eutectic solution has frozen and the plates have reached a sufficiently low temperature, the freezing cycle is terminated and the storage area may be returned to use during an operating period. During the operating period, air is blown across the plates to cool the storage area while the truck is used to deliver the cargo to its destination.

Over the course of the operating period, frost may accumulate on the surface of the plates due to moisture in the air. Since frost acts as a thermal insulator, the presence of frost on the plates and between adjacent plates reduces their cooling efficiency, so the plates must be periodically defrosted.

There are several known methods for defrosting the plates. For example, U.S. Pat. No. 3,727,422 describes a method of applying water to the surfaces of the plates to remove frost. In another system, which is described in U.S. Pat. No. 4,043,144, a defrost coil is positioned against the outer surfaces of the plates and hot gas is run therethrough to defrost the plates. U.S. Pat. No. 6,595,019 describes yet another system, which employs vertical scrapers that are moved across the outer surfaces of the plates to remove frost. All of these patents are hereby incorporated herein by reference.

All of these methods have certain disadvantages. For example, using water to defrost the plates requires an operator to connect a water hose to a water dispersal or spray system to begin the defrosting process by running relatively warm water over the frost. Then the water falling off of the plates has to be collected and disposed of. And finally the operator has to disconnect the hose when the defrosting process is completed.

In view of the foregoing, there is a need for a defrost system and method which are not only effective, but which also eliminate the need for human intervention for defrosting control.

SUMMARY

There are several aspects of the present subject matter which may be embodied in the devices and systems described and claimed below. These aspects may be employed alone or in combination with other aspects of the subject matter described herein.

In one aspect, a method is provided for defrosting a eutectic plate of a refrigeration system. The method involves initiating a defrost cycle for the eutectic plate by operating a defrost means upon connection of a power source to the refrigeration system. Operation of the defrost means is terminated upon completion of all or a portion of the defrost cycle and then the initiation of a subsequent defrost cycle is prevented until the power source has been disconnected from the refrigeration system for at least a selected amount of time.

In a separate aspect, a defrost system for a refrigeration system including a eutectic plate is provided. The defrost system includes a controller and defrost means operable during a defrost cycle to defrost the eutectic plate. The controller is programmed to carry out a number of operations, including initiating a defrost cycle by operating the defrost means upon connection of a power source to the refrigeration system. The controller is also programmed to terminate operation of the defrost means upon completion of all or a portion of the defrost cycle and then prevent the initiation of a subsequent defrost cycle until the power source has been disconnected from the refrigeration system for at least a selected amount of time.

In yet another separate aspect, a method is provided for defrosting a eutectic plate of a refrigeration system. The method involves establishing a defrost cycle time corresponding to the total time which a defrost means must be operative to complete a defrost cycle and establishing a time window in which to complete the defrost cycle. The defrost means is operated to defrost the eutectic plate upon connection of a power source to the refrigeration system and is subsequently deactivated if the defrost means completes the defrost cycle or if the defrost window expires before the defrost means completes the defrost cycle. A subsequent defrost window cannot be initiated until the power source has been disconnected from the refrigeration system for at least a selected amount of time.

In another separate aspect, a defrost system for a refrigeration system including a eutectic plate is provided. The defrost system includes a controller and defrost means operable during a defrost cycle to defrost the eutectic plate. The controller is programmed to carry out a number of operations, including establishing a defrost window time corresponding to the total time which the defrost means must be operative to complete a defrost cycle and establishing a time window in which to complete the defrost cycle. The controller is also programmed to initiate operation of the defrost means to defrost the eutectic plate upon connection of a power source to the refrigeration system and subsequently deactivate the defrost means if the defrost means completes the defrost cycle or if the defrost window expires before the defrost means completes the defrost cycle. The controller prevents the initiation of a subsequent defrost window until the power source has been disconnected from the refrigeration system for at least a selected amount of time.

In yet another separate aspect, a method is provided for defrosting a eutectic plate of a refrigeration system. The method involves sensing connection of a power source to the refrigeration system and initiating the operation of a window timer, a defrost timer, and a defrost means upon connection of a power source to the refrigeration system. The window timer tracks the amount of time elapsed since the controller initiated the operation of the window timer, the defrost timer, and the defrost means and produces a window time output. The defrost timer tracks the accumulated time during which the defrost means is operative and produces a defrost time output. The window time output is periodically compared to a maximum window time value and the defrost means is deactivated if the window time output is greater than or equal to the maximum window time value. The defrost time output is periodically compared to a maximum defrost time value so long as the window time output is less than the maximum window time value. If the defrost time output is greater than or equal to the maximum defrost time value, the defrost means is deactivated. When the defrost means has been deactivated, the disconnection of the power source from the refrigeration system is sensed and, upon such disconnection, a reset timer is initiated. The reset timer tracks the time during which the power source is disconnected from the refrigeration system and produces a reset time output. The reset time output is compared to a minimum reset time value and, if the reset time output is greater than or equal to the minimum reset time value, the foregoing process is repeated upon reconnection of the power source to the refrigeration system.

In another separate aspect, a defrost system is provided for a refrigeration system including a eutectic plate. The defrost system includes a controller and defrost means operable during a defrost cycle to defrost the eutectic plate. The controller is programmed to carry out a number of operations, including sensing connection of a power source to the refrigeration system and initiating the operation of a window timer, a defrost timer, and the defrost means upon connection of a power source to the refrigeration system. The window timer tracks the amount of time elapsed since the controller initiated the operation of the window timer, the defrost timer, and the defrost means and produces a window time output. The defrost timer tracks the accumulated time during which the defrost means is operative and produces a defrost time output. The controller is programmed to periodically compare the window time output to a maximum window time value and deactivate the defrost means if the window time output is greater than or equal to the maximum window time value. The controller is also programmed to periodically compare the defrost time output to a maximum defrost time value when the window time output is less than the maximum window time value. If the defrost time output is greater than or equal to the maximum defrost time value, the controller deactivates the defrost means. When the defrost means has been deactivated, the controller senses disconnection of the power source from the refrigeration system and, upon such disconnection, initiates a reset timer. The reset timer tracks the time during which the power source is disconnected from the refrigeration system and produces a reset time output. The controller is programmed to compare the reset time output to a minimum reset time value and, if the reset time output is greater than or equal to the minimum reset time value, to repeat the foregoing process upon reconnection of the power source to the refrigeration system.

DESCRIPTION OF SEVERAL EMBODIMENTS

The embodiments disclosed herein are for the purpose of providing the required description of the present subject matter. These embodiments are only exemplary, and may be embodied in various forms. Therefore, specific details disclosed herein are not to be interpreted as limiting the subject matter as defined in the accompanying claims.

Figure 1:
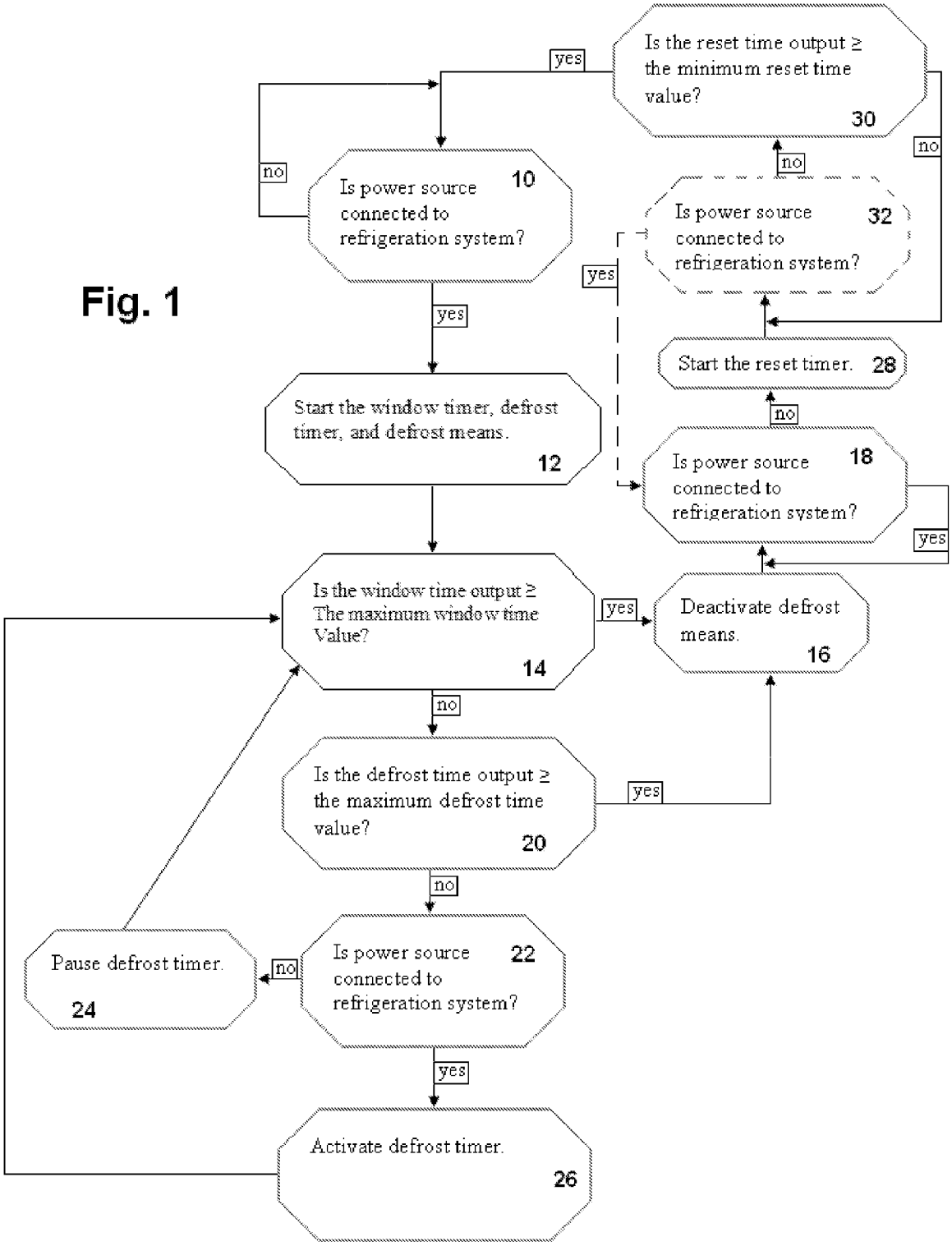
FIG. 1 is a flow chart illustrating a method for defrosting the eutectic plate of a refrigeration system.

FIG. 1 illustrates a method for automatically defrosting the eutectic plate of a refrigeration system. This method may be fully automated and carried out by a controller, thereby eliminating the need for human intervention for defrosting control. The controller may be a CPU programmed to carry out the illustrated protocol and interact with an associated defrost system. In one embodiment the controller comes pre-programmed with the desired protocol and is stored in a sealed enclosure, which prevents tampering while protecting the controller from conditions in and around the refrigeration system. In other embodiments, the controller may be stored in a housing with external controls that may be manipulated by an operator to alter the current protocol.

The illustrated method may be employed with a refrigeration system having an associated defrost means and one or more eutectic plates. The methods for interacting with a single-plate refrigeration system will be described first, followed by the methods for interacting with a multi-plate refrigeration system.

In a typical refrigeration system having a eutectic plate, an external power source is connected to the system to freeze the eutectic solution during a non-operating period. The process of freezing the eutectic solution in one or more plates will be referred to herein as a "freezing cycle." The controller is associated with the refrigeration system and can sense when a power source is connected for initiating a freezing cycle. The controller is programmed to, upon the very first connection of a power source, start a defrost cycle.

If the refrigeration system includes only one eutectic plate, the controller implements the defrost cycle to defrost the plate while temporarily preventing the freezing cycle. When the defrost cycle is completed (either by being fully performed or timing out), the controller may initiate a freezing cycle to freeze the now-defrosted plate.

Figure 2:
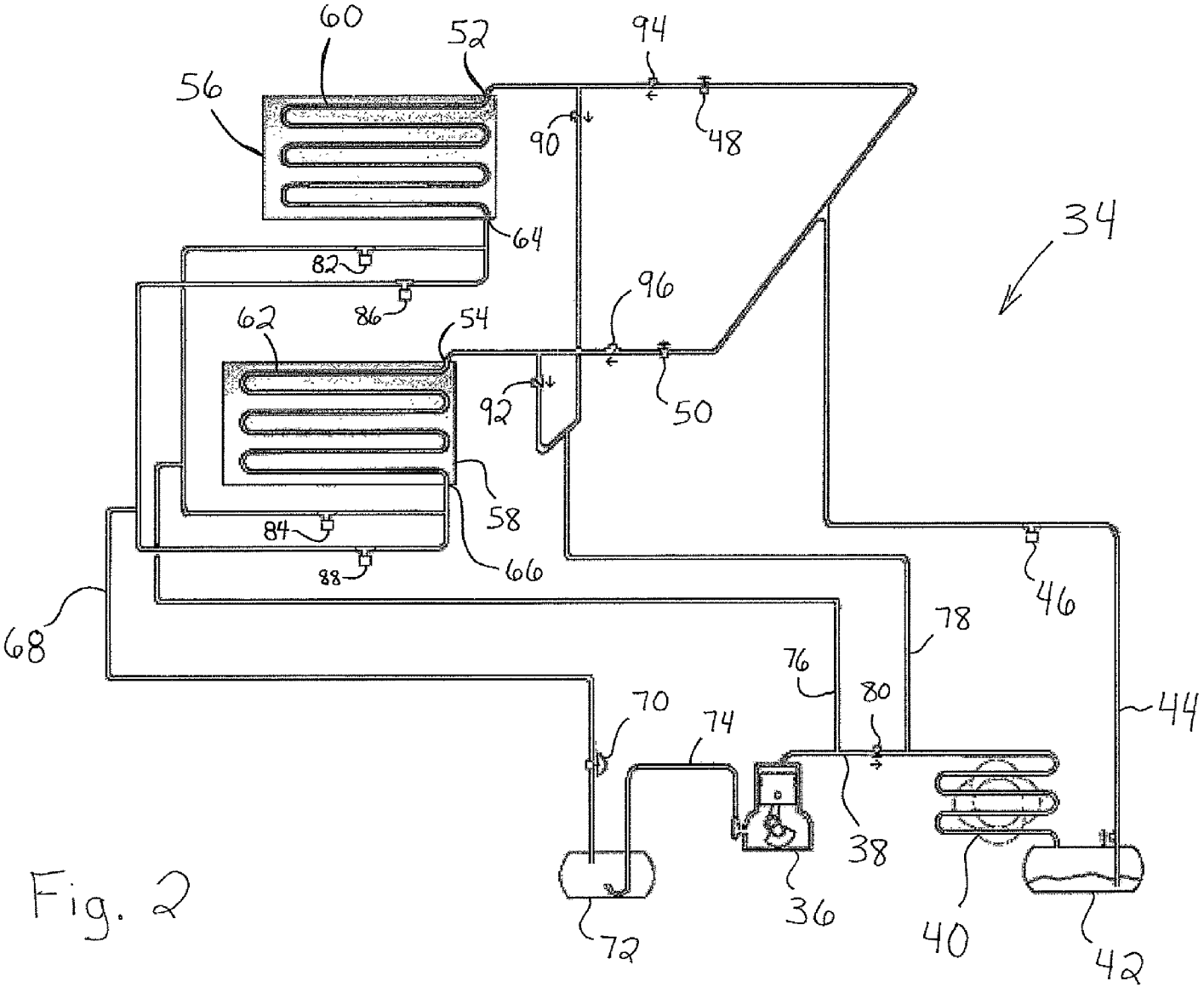
FIG. 2 is a schematic illustration of a refrigeration system suitable for use with the defrosting method of FIG. 1.

The defrost cycle begins at step 10 (FIG. 1), when the controller senses that a power source is connected to the refrigeration system. Next, the controller advances the protocol to step 12, in which it initiates the operation of a window timer, a defrost timer, and a defrost means. Any programmable defrost means may be employed with the methods according to the present disclosure. One suitable defrost means is illustrated in FIG. 2 and will be described in greater detail below.

The window timer tracks the amount of time elapsed since the controller initiated operation of the window timer, defrost timer, and defrost means. The window timer also produces a window time output. The window timer is operative independent of the power source and will continue operating even when the power source is disconnected from the refrigeration system.

The defrost timer tracks the accumulated time during which the defrost means is operative and produces a defrost time output. The defrost timer is only operative when the power source is connected to the refrigeration system and will pause when the power source has been disconnected. When the power source is reconnected (and when other conditions are also met), the defrost timer will un-pause and continue tracking the time during which the defrost means is operative.

In the next step 14, the controller compares the window time output (from the window timer) to a maximum window time value. The maximum window time value represents the time frame in which the defrost means may be operative and its duration may vary according to the configuration of the associated refrigeration system. However, for illustrative purposes, the maximum window time value may be four hours, meaning that the defrost means may be operative during the first four-hour window after the power source has been initially connected to the refrigeration system.

If the window time output is equal to or greater than the maximum window time value, the controller implements step 16. In step 16, the controller deactivates the defrost means (even if the power source is still connected to the refrigeration system) and may initiate a freezing cycle to freeze the eutectic plate. From step 16, the controller advances the protocol to step 18, in which the controller begins the process of determining whether it is proper to start the next defrost cycle. Step 18 will be described in greater detail below.

On the other hand, if the window time output is less than the maximum window time value (meaning that the defrost cycle has not timed out), the controller advances the protocol to step 20. In step 20, the controller compares the defrost time output (from the defrost timer) to a maximum defrost time value. The maximum defrost time value represents the maximum time for which the defrost means may be operative (referred to herein as the "defrost cycle time") and its duration may vary according to the configuration of the associated refrigeration system. However, for illustrative purposes, the maximum defrost time value may be two hours, meaning that the defrost means may only be operative for a total of two hours during a given defrost window.

The defrost means is only operative while the power source is connected to the refrigeration system, meaning that the defrost timer is also only operative while the power source is connected to the refrigeration system. By way of example, suppose a power source is connected to a refrigeration system, then disconnected one hour later, left disconnected for one hour, and then reconnected for another half hour. During this time, the defrost means is only operative for one and one half hours and the defrost time output will reflect this value by counting the first hour of operation time, then pausing for one hour, and then adding another half hour of operation time. In contrast, the window timer is operative the entire time, meaning that the window time output will reflect that it has been two and one half hours since the power source was first connected to the refrigeration system.

Returning now to step 20, if the defrost time output is equal to or greater than the maximum defrost time value (meaning that the defrost cycle has been completed), the controller advances the protocol to step 16. In step 16, the controller deactivates the defrost means and may initiate a freezing cycle to freeze the eutectic plate.

On the other hand, if the defrost time output is less than the maximum defrost time value (meaning that the defrost cycle has not been completed), the controller advances the protocol to step 22. In step 22, the controller checks if the power source is connected to the refrigeration system. If not, controller moves the protocol to step 24, during which step the controller pauses the defrost timer (or allows it to remain paused). Thereafter, the protocol returns to step 14 to check the window timer.

If the power source is connected to the refrigeration system during step 22, the controller moves the protocol to step 26, during which step the controller reactivates the defrost timer (if it was inactive moving into step 22) or otherwise allows it to remain operating. With the defrost timer in an operative mode, the controller returns the protocol to step 14 to check the window timer.

On account of the foregoing programming, the defrost timer and the defrost means are only operable during the time frame, or window, represented by the maximum window time value. Therefore, depending on the circumstances, the controller may terminate operation of the defrost means before completing the defrost cycle (i.e., the full operating time represented by the maximum defrost time value). For example, in an exemplary embodiment, the maximum window time value is four hours and the maximum defrost time value is two hours, meaning that the defrost system may be operative for up to two hours, but only within the first four-hour window after the power source is first connected to the refrigeration system. If the power source is connected to the refrigeration system, then disconnected half an hour later and plugged in again three hours later, the defrost means will operate for one hour (i.e., less than the two-hour full operating time) before it is deactivated by the controller (on account of expiration of the time frame represented by the maximum window time value).

As referenced above, step 16 represents the time when the defrost means is deactivated, either by the window timer registering a time-out for the defrost cycle (represented by the transition from step 14 to step 16) or by the defrost cycle being completed (represented by the transition from step 20 to step 16). The controller may initiate a freezing cycle at this time to freeze the plate. An exemplary freezing cycle will be described in greater detail below.

Once the eutectic solution in the plate has been frozen (or reaches a sufficiently low temperature) and the time has come to transport cargo in the storage area, the power source is disconnected from the refrigeration system and air is blown across the plate to cool the storage area during an operating period. Ideally, the next defrost cycle does not automatically begin simply upon reconnection of the power source to the refrigeration system, but waits until the operating period is completed.

In the illustrated embodiment, such a control scheme is implemented by preventing the next defrost cycle from beginning until the power source has been disconnected from the refrigeration system for a selected amount of time. Particularly, the controller advances the protocol from step 16 to step 18 and then periodically checks to see if the power source is connected to the refrigeration system. When the controller determines that the power source has been disconnected from the refrigeration system, it advances the protocol from step 18 to step 28 and initiates a reset timer. The reset timer tracks the time during which the power source is disconnected from the refrigeration system and may work in a number of ways.

In one embodiment, the reset timer tracks the amount of time that the power source has been continuously disconnected from the refrigeration system. If the power source is disconnected for an eight-hour operating period, but briefly reconnected halfway through the operating period before being disconnected again for the operating period, the reset timer will be reinitiated upon the most recent disconnect and only register four hours (i.e., the time that the power source was disconnected from the refrigeration system after having being briefly reconnected). In general, there is rarely a reason for the power source to be reconnected to the refrigeration system between freezing cycles, so the incidence of re-initialization of the reset timer is exceedingly rare.

In another embodiment, the reset timer tracks the accumulated time that the power source has been disconnected from the refrigeration system. This prevents the situation described above with regard to the "continuous disconnection" embodiment of the reset timer. For example, when employing an "accumulated disconnection" reset timer, if the power source is disconnected for an eight-hour operating period, but briefly reconnected halfway through the operating period before being disconnected again for the operating period, the reset timer will register approximately eight hours.

In yet another embodiment, the reset timer tracks the elapsed time since the power source was disconnected from the refrigeration system. When employing such a reset timer, if the power source is disconnected for an eight-hour operating period, but reconnected midway through the operating period before being disconnected again for the operating period, the reset timer will register eight hours (regardless of the amount of time that the power source was connected to the refrigeration system during the operating period). Other reset timers may also be employed without departing from the scope of the present disclosure.

The reset timer produces a reset time output, which the controller periodically compares to a minimum reset time value in step 30. The minimum reset time value represents the amount of time that the power source must be disconnected from the refrigeration system before the next defrost cycle may begin. The magnitude of the minimum reset time value may vary to suit operator needs, but in various embodiments, may approximate the length of a typical operating cycle, or it may be twelve hours.

If the particular reset timer is of the type that is affected by reconnection of the power source to the refrigeration system before the reset time output is greater than or equal to the minimum reset time value, an additional step 32 may be inserted between steps 28 and 30. In step 32, the controller checks whether the power source is connected to the refrigeration system. If the power source remains disconnected from the refrigeration system, the controller will advance the protocol from step 32 to step 30 and compare the reset time output and the minimum reset time value. However, if the controller finds in step 32 that the power source has been reconnected to the refrigeration system, a number of different operations may be performed, depending on the nature of the reset timer. For example, when employing a "continuous disconnection" reset timer, the reset timer should be reinitiated when the power source is reconnected from the refrigeration system and subsequently disconnected again. This is achieved by moving from step 32 to step 18 (as shown in FIG. 1), with the controller eventually reinitiating the reset timer in step 28 when the power source has been disconnected from the refrigeration system again. For other types of reset timers, step 32 may result in different operations (e.g., pausing the reset timer when the power source is reconnected to the refrigeration system and then reactivating the reset timer when the power source has been disconnected again) or may be omitted.

If the reset time output is less than the minimum reset time value (meaning that the power source has not been disconnected from the refrigeration system for a sufficient time), step 30 (and step 32 for systems requiring such a step) will be repeated periodically. This temporarily prevents the initiation of a subsequent defrost cycle.

When the reset time output is greater than or equal to the minimum reset time value (meaning that the power source has been disconnected from the refrigeration system for a sufficient time), the protocol moves to step 10. In step 10, as described above, the controller checks whether the power source is connected to the refrigeration system. If not, then step 10 is periodically repeated until the controller senses that the power source has been connected to the refrigeration system. When the controller senses that the power source has been connected to the refrigeration system, the protocol moves to step 12 and reinitiates the window timer, defrost timer, and defrost means and the above-described process is repeated. Hence, it will be seen that the entire defrost system is fully automated by the controller and timers, with the reset timer eliminating the need for any human input when starting a defrost cycle and the other timers automating each individual defrost cycle.

If the refrigeration system includes multiple eutectic plates, the protocol of FIG. 1 may be slightly modified. In one embodiment, the protocol includes a mechanism for switching between the various plates, such that a first plate will be defrosted during a given defrost cycle and then a second plate will be defrosted during the next defrost cycle. This may be accomplished by programming the controller with an alternator circuit that automatically switches from one plate to the next sometime between consecutive defrost cycles. For example, this may be achieved during step 16 (i.e., switching a "plate" value from "plate 1" to "plate 2" when the defrost means is deactivated) or during step 12 (i.e., switching a "plate" value from "plate 1" to "plate 2" when the defrost cycle begins).

While the one plate is being defrosted, a freezing cycle may be used to freeze the eutectic solution in the other plates. When the defrost cycle for the one plate ends, it may be frozen to ensure that all of the plates are frozen for the next operating period. While this embodiment only defrosts one plate during each defrost cycle, it has been found that this is sufficient to ensure proper operation of the refrigeration system. In an alternative version of this system, a plate selection feature may be employed to allow an operator or the controller to select a particular plate to defrost, rather than automatically rotating to the plate which is next in line.

In alternative embodiments of a multi-plate defrost system, all of the plates may be defrosted during a given defrost cycle. This may be carried out sequentially or simultaneously, although it may be advantageous to employ a simultaneous defrosting protocol to ensure that there is sufficient time to freeze all of the plates after they have been defrosted.

Other features may also be employed with the above-described defrost systems and methods without departing from the scope of the present disclosure. For example, a defrost system employed with a multi-plate refrigeration system may include a maintenance input for fast-cycling between the various plates. An evaluation mode featuring much shorter timer windows (e.g., a maximum defrost time value of two minutes, a maximum window time value of four minutes, and a minimum reset time value of twelve seconds) may be employed for diagnostic and/or demonstration purposes.

It should be clear from the foregoing that defrost control methods and systems according to the present disclosure may be employed with any plate-based transport or stationary refrigeration systems that are intermittently powered with one or more discontinuous energy sources. Similarly, the methods and systems of the present disclosure may also be employed with any programmable defrost system, including (but not limited to) the defrost systems described in U.S. Pat. Nos. 2,607,203 and 2,701,455, both of which are hereby incorporated herein by reference. For illustrative purposes, a suitable two-plate refrigeration system and accompanying defrost means are shown in FIG. 2.

The refrigeration system 34 of FIG. 2 includes a conventional compressor 36 connected by a hot gas line or discharge pipe 38 to a condenser 40. The output from the condenser 40 passes through a liquid receiver 42 and then through a liquid line 44 (regulated by a solenoid valve 46) to parallel connected thermal expansion valves 48 and 50. The thermal expansion valves 48 and 50 are respectively connected to the inlets 52 and 54 of eutectic plates 56 and 58. Each plate 56, 58 is filled with a eutectic solution and has a refrigeration coil 60, 62 passing therethrough from the inlet 52, 54 to an outlet 64, 66. The plate outlets 64 and 66 are connected to a conduit 68

(regulated by a crankcase pressure regulator 70) which leads to an accumulator 72. The output from the accumulator 72 is connected to the compressor 36 by another conduit 74.

As is conventional, vapor from the compressor 36 is superheated and passed to the condenser 40. The condenser 40 cools the superheated vapor and condenses it into a liquid, which is stored in the liquid receiver 42. From the liquid receiver 42, the cooled liquid passes through the expansion valves 48 and 50, which quickly decrease the pressure on the liquid, causing a portion of the liquid to evaporate and decreasing the temperature of the remaining liquid. The liquid/vapor mixture is passed into the refrigeration coils 60 and 62 of the plates 56 and 58, where it draws heat from the eutectic solution. Any liquid in the refrigeration coils 60 and 62 is vaporized as the temperature of the eutectic solution decreases. The vapor exits the refrigeration coils 60 and 62 and passes through the crankcase pressure regulator 70 to the accumulator 72. Finally, the vapor is passed back into the compressor 36 and the cycle is repeated until the eutectic solution in the plates 56 and 58 is frozen or reaches a sufficiently low temperature. Such a process has been referred to herein as a "freezing cycle."

In addition to the foregoing components, the refrigeration system 34 includes additional components, which are part of the defrost system or defrost means. The hot gas line 38 includes two takeoff conduits 76 and 78, with the first takeoff conduit 76 being connected to the hot gas line 38 upstream of a check valve 80 and the second takeoff conduit 78 being connected to the hot gas line 38 downstream of the check valve 80. The first takeoff conduit 76 is connected to the plate outlets 64 and 66 through normally closed solenoid valves 82 and 84, respectively. Normally open solenoid valves 86 and 88 are installed on the conduit 68 running between the plate outlets 64 and 66 and the accumulator 72.

As for the second takeoff conduit 78, it is connected to the plate inlets 52 and 54 through check valves 90 and 92, respectively. The second takeoff conduit 78 is isolated from the thermal expansion valves 48 and 50 by check valves 94 and 96, respectively.

In an exemplary defrost cycle, plate 56 is defrosted while plate 58 is being frozen. To defrost the plate 56, a controller according to the present disclosure opens the associated normally closed solenoid valve 82, while closing the associated normally open solenoid valve 86. This causes a portion of the superheated vapor from the compressor 36 to pass through the first takeoff conduit 76 and into the plate outlet 64. The remainder of the superheated vapor passes through the check valve 80 on the hot gas line 38 and continues through the refrigeration circuit to freeze the other plate 58.

The superheated vapor enters the refrigeration coil 60 of the plate 56 and transfers heat to the eutectic solution contained within the plate 56, which raises the temperature of the eutectic solution and eventually defrosts the plate 56. The vapor exits the plate inlet 52 and passes through the check valve 90 and the second takeoff conduit 78. The vapor moves from the second takeoff conduit 78 and back into the refrigeration circuit via the hot gas line 38, where it is passed through the condenser 40 and eventually is used to cool the other plate 58.

The controller is programmed to close the normally closed solenoid valve 82 and suspend the defrost cycle at appropriate times (e.g., when the power source is disconnected from the refrigeration system 34 or when the defrost cycle has been completed or times out). The controller may then open the normally open solenoid valve 86 to begin the freezing cycle for the plate 56.

While this invention has been described with reference to certain illustrative aspects, it will be understood that this description shall not be construed in a limiting sense. Rather, various changes and modifications can be made to the illustrative embodiments without departing from the true spirit and scope of the invention. Furthermore, it will be appreciated that any such changes and modifications will be recognized by those skilled in the art as an equivalent to the subject matter disclosed herein.

The invention claimed is:

1. A method of defrosting a eutectic plate of a refrigeration system, comprising the steps of:

initiating a defrost cycle for the eutectic plate by operating a defrost means upon connection of a power source to the refrigeration system;

terminating operation of the defrost means upon completion of all or a portion of the defrost cycle;

preventing the initiation of a subsequent defrost cycle until the power source has been disconnected from the refrigeration system for at least a selected amount of time.

2. The method of claim 1 further comprising the steps of initiating a subsequent defrost cycle upon connection of the power source to the refrigeration system after the refrigeration system has been disconnected from the power source for at least said selected amount of time.

3. The method of claim 2 wherein the refrigeration system includes a second eutectic plate and said initiating a subsequent defrost cycle includes initiating a defrost cycle for only the second eutectic plate.

4. The method of claim 1 wherein the refrigeration system includes a plurality of eutectic plates and said initiating a defrost cycle includes initiating a defrost cycle for only one of the eutectic plates.

5. The method of claim 4 wherein the step of initiating a defrost cycle for only one of the eutectic plates includes performing a freezing cycle for the other eutectic plates.

6. The method of claim 1 wherein the step of terminating operation of the defrost means includes initiating operation of a freezing cycle for the eutectic plate.

7. The method of claim 1 wherein the step of preventing the initiation of a subsequent defrost cycle includes preventing the initiation of a subsequent defrost cycle until the power source has been continuously disconnected from the refrigeration system for at least a selected amount of time.

8. A defrost system for a refrigeration system including a eutectic plate, the defrost system comprising:

a) defrost means operable during a defrost cycle to defrost the eutectic plate; and b) a controller programmed to:

i) initiate a defrost cycle by operating the defrost means upon connection of a power source to the refrigeration system;

ii) terminate operation of the defrost means upon completion of all or a portion of the defrost cycle;

iii) prevent the initiation of a subsequent defrost cycle until the power source has been disconnected from the refrigeration system for at least a selected amount of time.

9. The defrost system of claim 8 wherein the controller is programmed to initiate a subsequent defrost cycle upon connection of the power source to the refrigeration system after the refrigeration system has been disconnected from the power source for at least said selected amount of time.

10. The defrost system of claim 9 wherein the refrigeration system includes a second eutectic plate and the controller is programmed to initiate a subsequent defrost cycle for only the second eutectic plate upon connection of the power source to the refrigeration system after the refrigeration system has been disconnected from the power source for at least said selected amount of time.

11. The defrost system of claim 8 wherein the refrigeration system includes a plurality of eutectic plates and the controller is programmed to initiate a defrost cycle for only one of the eutectic plates.

12. The defrost system of claim 11 wherein the controller is programmed to simultaneously initiate operation of a defrost cycle for only one of the eutectic plates and initiate operation of a freezing cycle for the other eutectic plates.

13. The defrost system of claim 8 wherein the controller is programmed to initiate operation of a freezing cycle for the eutectic plate after if terminates operation of the defrost means.

14. The defrost system of claim 8 wherein the controller is programmed to prevent the initiation of a subsequent defrost cycle until the power source has been continuously disconnected from the refrigeration system for at least a selected amount of time.

15. A method of defrosting a eutectic plate of a refrigeration system, the method comprising:

a) establishing a defrost cycle time corresponding to the total time which a defrost means must be operative to complete a defrost cycle;

b) establishing a time window in which to complete the defrost cycle;

c) initiating operation of the defrost means to defrost the eutectic plate upon connection of a power source to the refrigeration system;

d) deactivating the defrost means if the defrost means completes the defrost cycle or if the time window expires before the defrost means completes the defrost cycle; and e) preventing the initiation of a subsequent defrost cycle until the power source has been disconnected from the refrigeration system for at least a selected amount of time.

16. The method of claim 15 further comprising repeating steps (a)-(e) upon connection of the power source to the refrigeration system after the power source has been disconnected from the refrigeration system for at least said selected amount of time.

17. The method of claim 16 wherein the refrigeration system includes a second eutectic plate and said repeating steps (a)-(e) includes initiating a subsequent defrost cycle for only the second eutectic plate.

18. The method of claim 15 wherein the refrigeration system includes a plurality of eutectic plates and said initiating operation of the defrost means includes initiating operation of the defrost means for only one of the eutectic plates.

19. The method of claim 18 wherein the step of initiating operation of the defrost means for only one of the eutectic plates includes performing a freezing cycle for the other eutectic plates.

20. The method of claim 15 wherein the step of deactivating the defrost means includes initiating operation of a freezing cycle for the eutectic plate.

21. The method of claim 15 wherein the step of preventing the initiation of a subsequent defrost cycle includes preventing the initiation of a subsequent defrost cycle until the power source has been continuously disconnected from the refrigeration system for at least a selected amount of time.

22. A defrost system for a refrigeration system including a eutectic plate, the defrost system comprising:

a) defrost means operable during a defrost cycle to defrost the eutectic plate; and b) a controller programmed to i) establish a defrost cycle time corresponding to the total time which the defrost means must be operative to complete a defrost cycle;

ii) establish a time window in which to complete the defrost cycle;

iii) initiate operation of the defrost means to defrost the eutectic plate upon connection of a power source to the refrigeration system;

iv) deactivate the defrost means if the defrost means completes the defrost cycle or if the time window expires before the defrost means completes the defrost cycle; and v) prevent the initiation of a subsequent defrost cycle until the power source has been disconnected from the refrigeration system for at least a selected amount of time.

23. The defrost system of claim 22 wherein the controller is programmed to repeat steps (i)-(v) upon connection of the power source to the refrigeration system after the power source has been disconnected from the refrigeration system for at least said selected amount of time.

24. The defrost system of claim 23 wherein the refrigeration system includes a second eutectic plate and the controller is programmed to repeat steps (i)-(v) for only the second eutectic plate.

25. The defrost system of claim 22 wherein the refrigeration system includes a plurality of eutectic plates and the controller is programmed to initiate operation of the defrost means to defrost only one of the eutectic plates upon connection of a power source to the refrigeration system.

26. The defrost system of claim 25 wherein the controller is programmed to perform a freezing cycle for the other eutectic plates.

27. The defrost system of claim 22 wherein the controller is programmed to initiate operation of a freezing cycle for the eutectic plate after deactivating the defrost means.

28. The defrost system of claim 22 wherein the controller is programmed to prevent the initiation of a subsequent defrost cycle until the power source has been continuously disconnected from the refrigeration system for at least a selected amount of time.

29. A method of defrosting a eutectic plate of a refrigeration system, the method comprising:

a) sensing connection of a power source to the refrigeration system;

b) initiating the operation of a window timer, a defrost timer, and a defrost means upon connection of a power source to the refrigeration system, wherein the window timer tracks the amount of time elapsed since the controller initiated the operation of the window timer, the defrost timer, and the defrost means and produces a window time output, and the defrost timer tracks the accumulated time during which the defrost means is operative and produces a defrost time output;

c) periodically comparing the window time output to a maximum window time value and deactivating the defrost means if the window time output is greater than or equal to the maximum window time value;

d) periodically comparing the defrost time output to a maximum defrost time value when the window time output is less than the maximum window time value and deactivating the defrost means if the defrost time output is greater than or equal to the maximum defrost time value;

e) sensing disconnection of the power source from the refrigeration system after the defrost means has been deactivated in (c) or (d) and initiating the operation of a reset timer when the power source is disconnected from the refrigeration system, wherein the reset timer tracks the time during which the power source is disconnected from the refrigeration system and produces a reset time output; and f) comparing the reset time output to a minimum reset time value and, if the reset time output is greater than or equal to the minimum reset time value, repeating steps (a)-(e) upon reconnection of the power source to the refrigeration system.

30. The method of claim 29 wherein the refrigeration system includes a second eutectic plate and said repeating of steps (a)-(e) includes repeating steps (a)-(e) for only the second eutectic plate.

31. The method of claim 29 wherein the refrigeration system includes a plurality of eutectic plates and said initiating the operation of a window timer, a defrost timer, and a defrost means includes initiating the operation of a defrost means for only one of the eutectic plates.

32. The method of claim 31 wherein the step of initiating the operation of a window timer, a defrost timer, and a defrost means includes performing a freezing cycle for the other eutectic plates.

33. The method of claim 29 wherein the step of deactivating the defrost means in steps (c) and (d) includes initiating operation of a freezing cycle for the eutectic plate.

34. The method of claim 29 wherein the reset timer tracks the time during which the refrigeration system is continuously disconnected from the power source.

35. The method of claim 29 wherein said periodically comparing the window time output to a maximum window time value includes operating the window timer regardless of whether the power source is connected to the refrigeration system.

36. The method of claim 29 wherein said periodically comparing the defrost time output to a maximum defrost time value includes operating the defrost timer when the power source is connected to the refrigeration system and pausing the defrost timer when the power source is disconnected from the refrigeration system.

37. A defrost system for a refrigeration system including a eutectic plate, the defrost system comprising:

defrost means operable during a defrost cycle to defrost the eutectic plate; and a controller programmed to (a) sense connection of a power source to the refrigeration system;

(b) initiate the operation of a window timer, a defrost timer, and the defrost means upon connection of a power source to the refrigeration system, wherein the window timer tracks the amount of time elapsed since the controller initiated the operation of the window timer, the defrost timer, and the defrost means and produces a window time output, and the defrost timer tracks the accumulated time during which the defrost means is operative and produces a defrost time output;

(c) periodically compare the window time output to a maximum window time value and deactivate the defrost means if the window time output is greater than or equal to the maximum window time value;

(d) periodically compare the defrost time output to a maximum defrost time value when the window timer output is less than the maximum window time value and deactivate the defrost means if the defrost time output is greater than or equal to the maximum defrost time value;

(e) sense disconnection of the power source from the refrigeration system after the defrost means has been deactivated in (c) or (d) and initiate the operation of a reset timer when the power source is disconnected from the refrigeration system, wherein the reset timer tracks the time during which the power source is disconnected from the refrigeration system and produces a reset time output; and (f) compare the reset time output to a minimum reset time value and, if the reset time output is greater than or equal to the minimum reset time value, repeat (a)-(e) upon reconnection of the power source to the refrigeration system.

38. The defrost system of claim 37 wherein the refrigeration system includes a second eutectic plate and the controller is programmed to repeat steps (a)-(e) for only the second eutectic plate upon reconnection of the power source to the refrigeration system if the reset time output is greater than or equal to the minimum reset time value.

39. The defrost system of claim 37 wherein the refrigeration system includes a plurality of eutectic plates and the controller is programmed to initiate the operation of a window timer, a defrost timer, and a defrost means for only one of the eutectic plates upon connection of a power source to the refrigeration system.

40. The defrost system of claim 39 wherein the controller is programmed to perform a freezing cycle for the other eutectic plates when operating the defrost means for said only one of the eutectic plates.

41. The defrost system of claim 37 wherein the controller is programmed to initiate operation of a freezing cycle for the eutectic plate after deactivating the defrost means in (c) or (d).

42. The defrost system of claim 37 wherein the reset timer tracks the time during which the refrigeration system is continuously disconnected from the power source.

43. The defrost system of claim 37 wherein the controller is programmed to operate the window timer regardless of whether the power source is connected to the refrigeration system.

44. The defrost system of claim 37 wherein the controller is programmed to operate the defrost timer when the power source is connected to the refrigeration system and pausing the defrost timer when the power source is disconnected from the refrigeration system.

* * * * *